US009379452B2

(12) United States Patent
Andrenko

(10) Patent No.: US 9,379,452 B2
(45) Date of Patent: Jun. 28, 2016

(54) ANTENNA APPARATUS HAVING FOUR INVERTED F ANTENNA ELEMENTS AND GROUND PLANE

(71) Applicant: FUJITSU LIMITED, Kawasaki-shi, Kanagawa (JP)

(72) Inventor: Andrey S. Andrenko, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 105 days.

(21) Appl. No.: 14/218,754

(22) Filed: Mar. 18, 2014

(65) Prior Publication Data

US 2015/0048995 A1 Feb. 19, 2015

(30) Foreign Application Priority Data

Aug. 13, 2013 (JP) ..... 2013-168239

(51) Int. Cl.

| | |
|---|---|
| ***H01Q 21/00*** | (2006.01) |
| ***H01Q 1/22*** | (2006.01) |
| ***H01Q 9/04*** | (2006.01) |
| ***H01Q 9/42*** | (2006.01) |
| ***H01Q 21/24*** | (2006.01) |

(52) U.S. Cl.

CPC ..... *H01Q 21/00* (2013.01); *H01Q 1/2216* (2013.01); *H01Q 9/0421* (2013.01); *H01Q 9/42* (2013.01); *H01Q 21/24* (2013.01)

(58) Field of Classification Search

CPC ..... H01Q 21/00; H01Q 21/24; H01Q 21/26; H01Q 1/2216; H01Q 9/0421; H01Q 9/42

USPC ..... 343/893

See application file for complete search history.

(56) References Cited

U.S. PATENT DOCUMENTS 6,297,776 B1 * 10/2001 Pankinaho ..... H01Q 1/243 343/700 MS
2002/0047807 A1 * 4/2002 Talvitie ..... H01Q 9/0421 343/702

(Continued)

FOREIGN PATENT DOCUMENTS

EP 0 450 881 A2 10/1991
EP 1 052 723 A2 11/2000

(Continued)

OTHER PUBLICATIONS

European Search Report dated Jun. 1, 2015; Application No. 14160495.9.

(Continued)

*Primary Examiner* — Sue A Purvis
*Assistant Examiner* — Ab Salam Alkassim, Jr.
(74) *Attorney, Agent, or Firm* — Arent Fox LLP

(57) ABSTRACT

An antenna apparatus includes a ground plane having a rectangular shape in plan view, and four inverted F antenna elements configured to be placed on a surface of the ground plane and to be arranged in a symmetrical manner with respect to the central point of the ground plane in plan view, wherein each of the four inverted F antenna elements includes a short strip extending from one end of a main strip to the short end, a feeding strip, an open strip configured to extend toward the open end from the other end of the main strip to a position placed at a second height lower than the first height, and an end strip configured to extend from a distal end of the open strip to the open end and placed parallel to the ground plane at the second height.

9 Claims, 12 Drawing Sheets

(56) References Cited

U.S. PATENT DOCUMENTS

| | | | | |
|---|---|---|---|---|
| 2002/0075192 | A1* | 6/2002 | Iwai | H01Q 9/0421 343/702 |
| 2003/0025637 | A1* | 2/2003 | Mendolia | H01Q 9/0421 343/702 |
| 2004/0087341 | A1* | 5/2004 | Edvardsson | H01Q 1/36 455/562.1 |
| 2012/0162021 | A1 | 6/2012 | Lee et al. | |
| 2012/0299784 | A1* | 11/2012 | Ayatollahi | H01Q 1/243 343/702 |
| 2013/0229318 | A1* | 9/2013 | Ng | H01Q 9/0421 343/770 |

FOREIGN PATENT DOCUMENTS

| | | | | |
|---|---|---|---|---|
| EP | 1 209 759 | A1 | 5/2002 | |
| EP | 2 535 983 | A1 | 12/2012 | |
| GB | EP 0450881 | A2 * | 10/1991 | H01Q 9/0407 |
| JP | 2012-231219 | A | 11/2012 | |
| WO | WO 2011/158057 | A1 | 12/2011 | |

OTHER PUBLICATIONS

Partial European Search Report mailed on Jan. 27, 2015 issued with respect to the corresponding European Patent Application No. 14160495.9.

* cited by examiner

| | |
|---|---|
| Type | Farfield |
| Approximation | enabled(kR>>1) |
| Monitor | farfield(f=0.919)[1[1,0]+2[1,90]+3[1,180]+4[1,270]] |
| Component | Abs |
| Output | Gain |
| Frequency | 0.919 |
| Rad.effic | −0.07394 dB |
| Tot.effic | −0.6864 dB |
| Gain | 4.392 dB |

| | |
|---|---|
| Type | Farfield |
| Approximation | enabled(kR>>1) |
| Monitor | farfield(f=0.919)[1[1,0]+2[1,90]+3[1,180]+4[1,270]] |
| Component | Axial Ratio |
| Frequency | 0.919 |

ANTENNA APPARATUS HAVING FOUR INVERTED F ANTENNA ELEMENTS AND GROUND PLANE

CROSS-REFERENCE TO RELATED APPLICATIONS

This patent application is based upon and claims the benefit of priority of the prior Japanese Patent Application No. 2013-168239 filed on Aug. 13, 2013, the entire contents of which are incorporated herein by reference.

FIELD

The embodiments discussed herein are related to an antenna apparatus.

BACKGROUND

Conventionally, there has been a planar inverted F antenna which includes a first radiation element and a second radiation element which is placed parallel to a ground plane and is extended along a longitudinal direction of the first radiation element. The second radiation element is shorter that the first radiation element. The second radiation element is disposed in a manner that the second radiation element substantially widens a width of the first radiation element at around a feeding point (see Patent Reference 1, for example).

Although the conventional planar inverted F antenna has a low profile and a wider bandwidth is achieved, an optimization for downsizing is not conducted.

PRIOR ART REFERENCES

Patent References

[Patent Reference 1] Japanese Patent Laid-Open Publication No. 2012-231219

SUMMARY

According to an aspect of an embodiment, there is provided an antenna apparatus including, a ground plane having a rectangular shape in plan view, and four inverted F antenna elements configured to be placed on a surface of the ground plane and to be arranged in a symmetrical manner with respect to the central point of the ground plane in plan view, the four inverted F antenna elements including short ends connected to the ground plane and open ends disposed on the opposite side of the short ends, respectively, wherein each of the four inverted F antenna elements includes, a main strip configured to be disposed between the short end and the open end and placed parallel to the ground plane at a first height, a short strip configured to extend from one end of the main strip to the short end, a feeding strip configured to extend from a middle point of the main strip to the ground plane and to have a feeding point at a distal end, an open strip configured to extend toward the open end from the other end of the main strip to a position placed at a second height lower than the first height, and an end strip configured to extend from a distal end of the open strip to the open end and placed parallel to the ground plane at the second height.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

A description is given, with reference to the accompanying drawings, of embodiments of an antenna apparatus.

<Embodiment>

Figure 1:
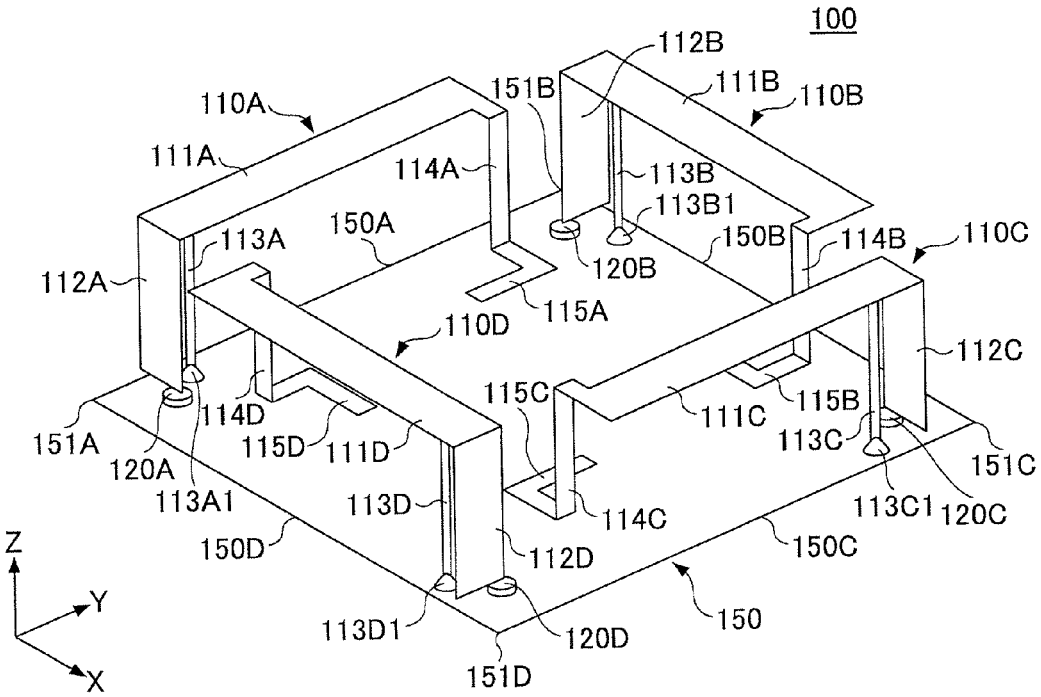
FIG. 1 is an oblique perspective diagram illustrating an antenna apparatus of an embodiment.

FIG. 1 is an oblique perspective diagram illustrating an antenna apparatus 100 of the embodiment. Hereinafter, the antenna apparatus 100 will be described by using a XYZ coordinate system as an orthogonal coordinate system.

The antenna apparatus 100 includes antenna elements 110A, 110B, 110C and 110D, capacitors 120A, 120B, 120C and 120D, and a ground plane 150.

The antenna elements 110A, 110B, 110C and 110D are disposed on a top surface of the ground plane 150 having a rectangular shape and are arranged along sides 150A, 150B, 150C and 150D of the ground plane 150, respectively.

The antenna elements 110A to 110D are planar inverted F antenna elements and have the same configuration with each other. The antenna elements 110A to 110D are arranged in a symmetrical manner with respect to the central point of the ground plane 150 in plan view.

The antenna elements 110A to 110D include main strips 111A, 111B, 111C and 111D, short strips 112A, 112B, 112C and 112D, feeding strips 113A, 113B, 113C and 113D, open strips 114A, 114B, 114C and 114D, and end strips 115A, 115B, 1150 and 115D, respectively.

The short strips 112A to 112D are connected to the ground plane 150 via the capacitors 120A to 120D, respectively. Accordingly, alternating current can flow between the short strips 112A to 112D and the ground plane 150.

Feeding points 113A1, 11331, 113C1 and 113D1 are located at end portions that are located in the negative side in the Z-axis direction of the feeding strips 113A to 113D.

Open strips 114A to 114D and end strips 115A to 115D are connected to the main strips 111A to 111D, respectively. Distal ends of the end strips 115A to 115D constitute open ends, respectively.

With regard to the antenna element 110A, the short strip 112A is connected to the ground plane 150 via the capacitor 120A, the feeding point 113A1 is disposed at the distal end of the feeding strip 113A, and the distal end of the end strip 115A constitutes the open end. Accordingly, the antenna element 110A constitutes the inverted F antenna element.

Similarly, with regard to the antenna elements 110B, 110C and 110D, the short strips 112B, 112C and 112D are connected to the ground plane 150 via the capacitors 120B, 120C and 120D, respectively, the feeding points 113B1, 113C1 and 113D1 are disposed at the distal ends of the feeding strips 1133, 113C and 113D, respectively, and the distal ends of the end strips 115B, 115C and 115D constitute the open ends, respectively. Accordingly, the antenna elements 110B, 110C and 110D constitute the inverted F antenna elements, respectively.

Figure 2A:
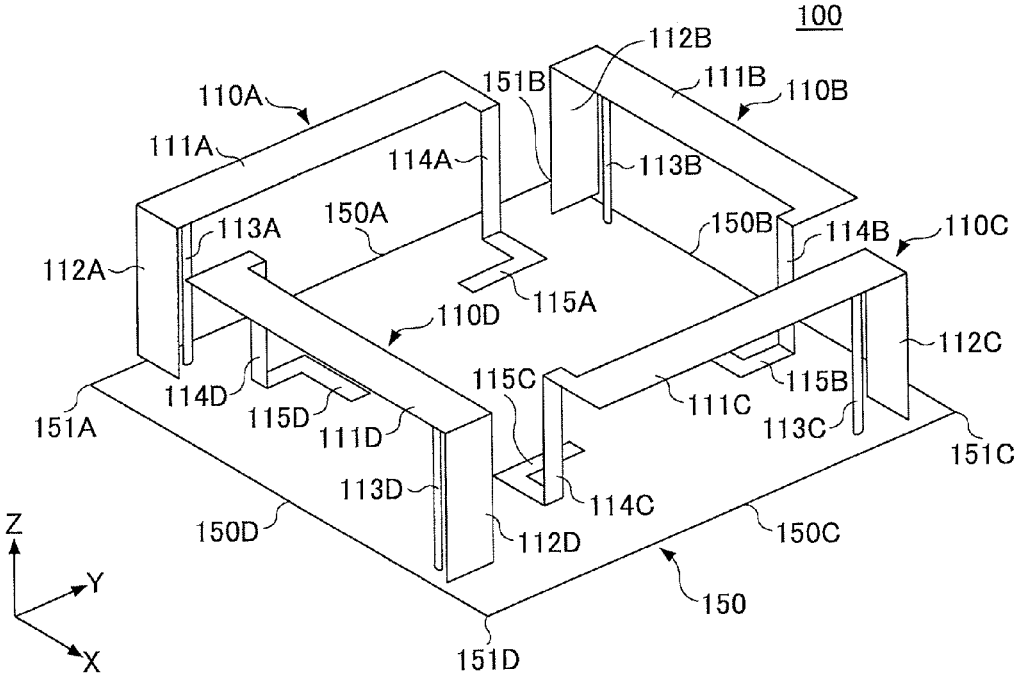
FIG. 2A is a diagram illustrating an antenna apparatus 100 of the embodiment in oblique perspective view.
Figure 2B:
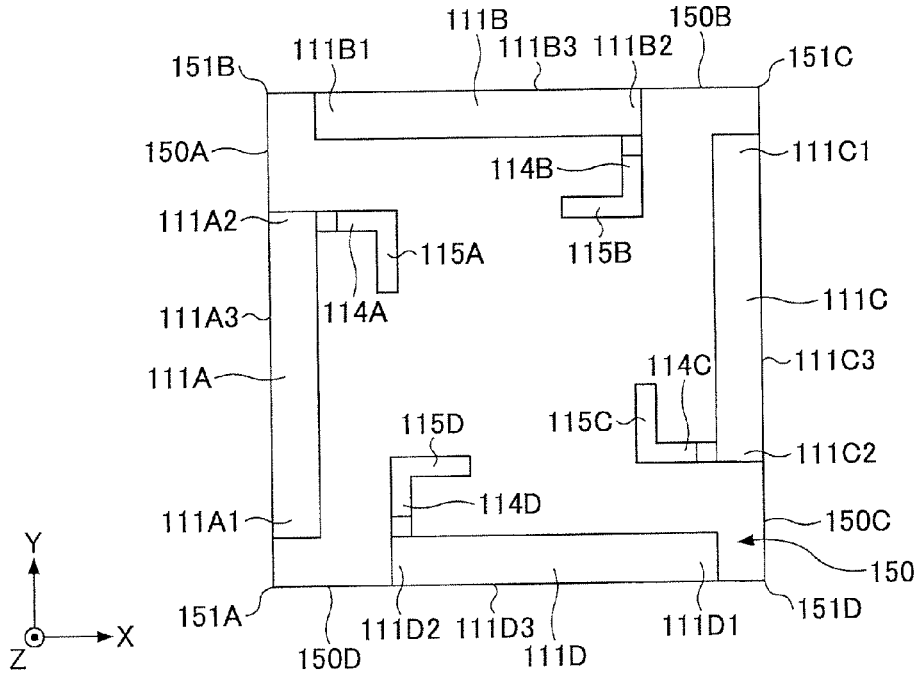
FIG. 2B is a diagram illustrating an antenna apparatus 100 of the embodiment in plan view.

FIG. 2A is a diagram illustrating an antenna apparatus 100 of the embodiment in oblique perspective view. FIG. 2B is a diagram illustrating an antenna apparatus 100 of the embodiment in plan view. FIG. 2A is obtained by omitting the capacitors 120A to 120D and the feeding points 113A1 to 113D1 from the antenna apparatus 100 as illustrated in FIG. 1. FIG. 23 illustrates an arrangement of the antenna elements 110A to 110D and the ground plane 150 in plan view.

As illustrated in FIG. 2B, the antenna elements 110A to 110D are placed in a manner that the end portions 111A1, 111B1, 111C1 and 111D1 of the main strips 111A to 111D are located close to corner portions 151A, 151B, 151C and 151D of the ground plane 150.

End portions 111A2, 111B2, 111C2 and 111D2 of the main strips 111A to 111D are located on the opposite side of the end portions 111A1 to 111D1. The open strips 114A to 114D are connected to the end portions 111A2 to 111D2, respectively.

With regard to the antenna elements 110A to 110D, the short strips 112A to 112D and the feeding strips 113A to 113D are located close to the corner portions 151A to 151D of the ground plane 150, respectively.

In the antenna elements 110A to 110D, the short strips 112A to 112D and the feeding strips 113A to 113D are located on near sides in the clockwise direction in plan view.

In the antenna elements 110A to 110D, the open strips 114A to 114D and the end strips 115A to 115D are located on far sides in the clockwise direction in plan view.

Accordingly, the open strip 114A and the end strip 115A are located close to the short strip 112B and the feeding strip 113B. Similarly, the open strip 114B and the end strip 115B are located close to the short strip 112C and the feeding strip 113C. The open strip 114C and the end strip 115C are located close to the short strip 112D and the feeding strip 113D. The open strip 114D and the end strip 115D are located close to the short strip 112A and the feeding strip 113A.

The antenna elements 110A to 110D are disposed in a manner that outer sides 111A3, 111B3, 111C3 and 111D3 of the main strips 111A to 111D correspond to the sides 150A, 150B, 150C and 150D of the ground plane 150, respectively, in plan view.

The antenna elements 110A to 110D of the antenna apparatus 100 as described above constitute Planar Inverted F Antennas (PIFAs), and are used for reading identifications (IDs) of Radio Frequency Identification (RFID) tags.

The antenna elements 110A to 110D have configurations that realize lowered mutual coupling, and read different RFID tags with each other.

The read signals that have 90 degree phase differences are input sequentially to feeding points 113A1 to 113D1 of the antenna elements 110A to 110D in this order. The phases of the read signals input to the feeding points 113B1 to 113D1 are delayed by 90 degrees, 180 degrees and 270 degrees with respect to the phase of the read signal input to the feeding point 113A1. Herein, 360 degrees corresponds to one cycle of the read signals. Accordingly, the antenna elements 110A to 110D radiate read signals that have 90 degree phase difference sequentially in this order.

The antenna apparatus 100 radiates circular polarized read signals to the positive Z-axis direction by causing antenna elements 110A to 110D to radiate read signals having 90 degree phase differences sequentially in this order.

For example, the antenna apparatus 100 can be used as follows. If a user of the antenna apparatus 100 which is connected to a reader-writer holds the antenna apparatus 100 in one hand and operates the reader-writer to cause the antenna apparatus 100 to radiate read signals toward goods to which RFID tags are attached, the reader-writer reads IDs of the RFID tags.

Since the antenna apparatus 100 is used for a purpose as described above, for example, it is preferable to reduce a size of the antenna apparatus 100 so that the user can hold the antenna apparatus 100 in one hand.

Next, an example of a configuration of the antenna apparatus 100 as a final end product will be described with reference to FIG. 3.

Figure 3:
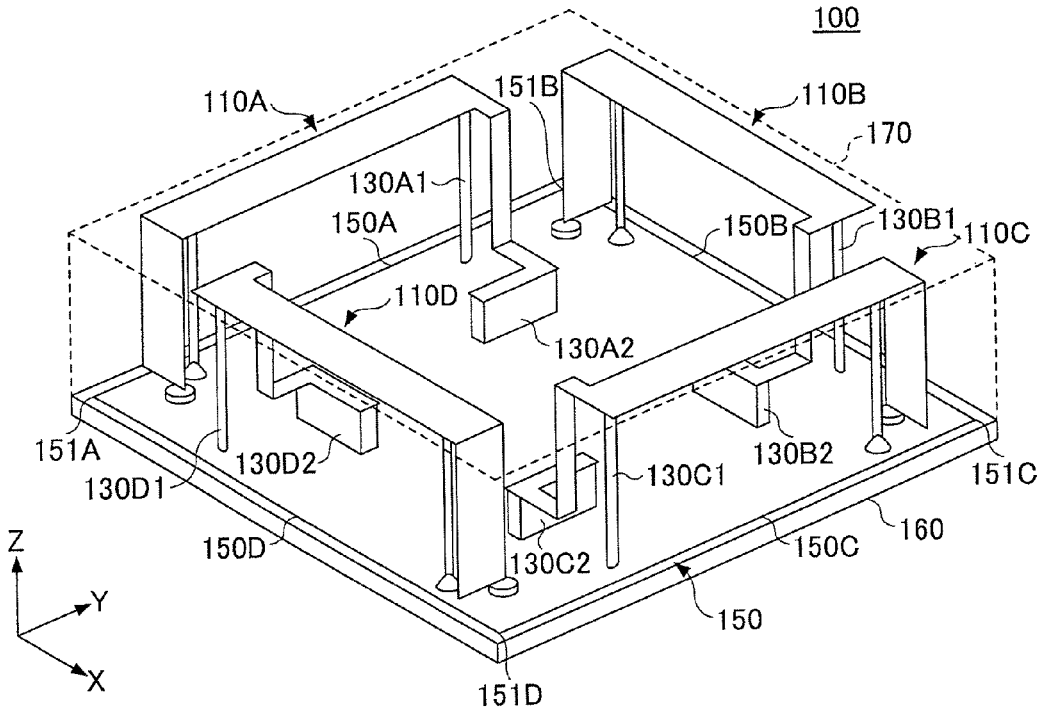
FIG. 3 is a drawing illustrating an example of the configuration of the antenna apparatus as a final end product.

FIG. 3 is a drawing illustrating an example of the configuration of the antenna apparatus 100 as the final end product.

The antenna apparatus 100 further includes pillars 130A1, 130A2, 130B1, 130B2, 130C1, 130C2, 130D1 and 130D2, a substrate 160 and a cover 170 in addition to the elements as illustrated in FIGS. 1 and 2.

The pillars 130A1, 130A2, 130B1, 130B2, 130C1, 130C2, 130D1 and 130D2 are made of insulating material and are disposed for the sake of supporting the antenna elements 110A to 110D on the ground plane 150.

The pillars 130A1 and 130A2 support the end portion 111A2 and the second strip 115A2 of the antenna element 110A on the ground plane 150, respectively. Similarly, the pillars 130B1 and 130B2 support the end portion 111B2 and the second strip 115B2 of the antenna element 110B on the ground plane 150, respectively. The pillars 130C1 and 130C2 support the end portion 111C2 and the second strip 115C2 of the antenna element 110C on the ground plane 150, respectively. The pillars 130D1 and 130D2 support the end portion 111D2 and the second strip 115D2 of the antenna element 110D on the ground plane 150, respectively.

The short strips 112A to 112D are fixed to the substrate 160 on the ground plane 150 via the capacitors 120A to 120D, respectively.

The feeding strips 113A to 113D are fixed to the substrate 160 at the feeding points 113A1 to 113D1, respectively.

For example, pillars made of insulating material may be disposed between the end portions 111A1 to 111D1 and the ground plane 150 in addition to the pillars 130A1, 130A2, 130B1, 130B2, 130C1, 130C2, 130D1 and 130D2.

Otherwise, foam like member such as a urethane foam may be used in order to support the antenna elements 110A to 110D in addition to or instead of these pillars.

The substrate 160 may be a type of a substrate such as a printed circuit board or a flexible substrate. An example of the printed circuit board is a flame retardant type 4 (FR4) substrate. An example of the flexible substrate is a polyimide film substrate. The ground plane 150 is formed on the top surface of the substrate 160. The top surface of the substrate 160 is located in the positive side in the Z-axis direction.

Hybrid RF devices are disposed on the bottom surface of the substrate 160. The hybrid RF devices are provided in order to input the read signals having 90 degree phase differences to the feeding points 113A1 to 113D1 sequentially in this order. The bottom surface of the substrate 160 is located in the negative side in the Z-axis direction. The hybrid RF devices will be described with reference to FIG. 4.

The cover 170 covers the elements of the antenna apparatus 100 other than substrate 160 and the cover 170 on the substrate 160. The cover 170 is a type of a housing which is made of resin and is formed in a cuboid shape having a square shaped opening in the negative side in the Z-axis direction.

In this embodiment, the pillars 130A1, 130A2, 130B1, 130B2, 130C1, 130C2, 130D1 and 130D2 are used for supporting the antenna elements 110A to 110D of the antenna apparatus 100 as described above.

However, the antenna apparatus 100 is not limited to the embodiment as described above.

For example, instead of using the pillars 130A1, 130A2, 130B1, 130B2, 130C1, 130C2, 130D1 and 130D2, the antenna elements 110A to 110D may be formed onto flexible substrates and the configurations of the antenna elements 110A to 110D as illustrated in FIG. 3 may be realized by bending the flexible substrates.

Figure 4:
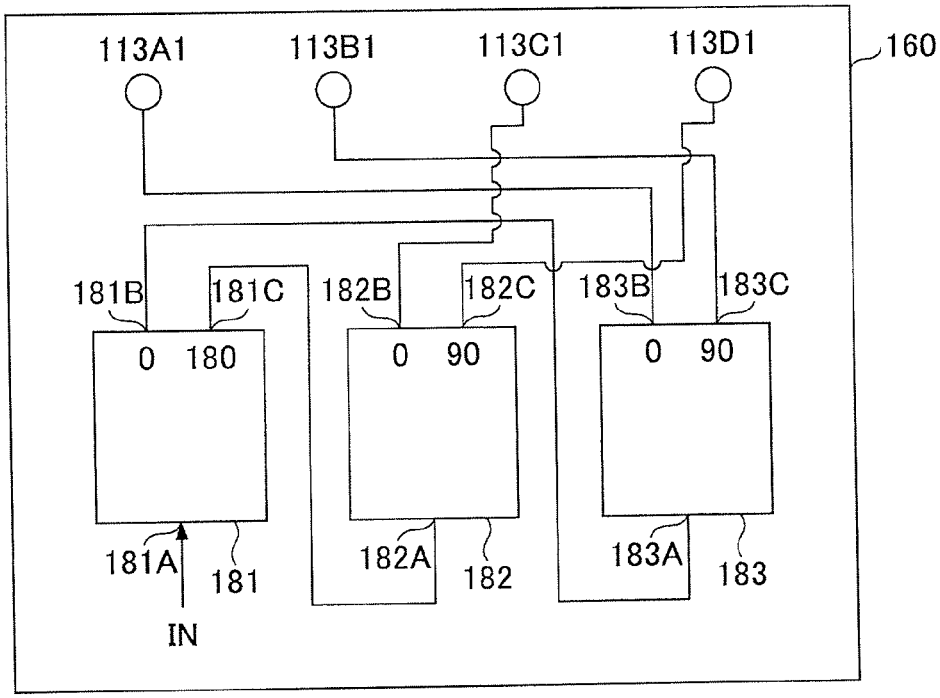
FIG. 4 is a diagram illustrating hybrid RF devices disposed on a bottom surface of a substrate of the antenna apparatus.

FIG. 4 is a diagram illustrating hybrid RF devices 181, 182 and 183 disposed on the bottom surface of the substrate 160 of the antenna apparatus 100.

The hybrid RF devices 181, 182 and 183 include input terminals 181A, 182A and 183A and output terminals 181B and 181C, 182B and 182C, and 183B and 183C, respectively.

The read signal of the reader-writer is input to the input terminal 181A of the hybrid RF device 181. The hybrid RF device 181 outputs the read signal input to the input terminal 181A to the output terminal 181B without changing or shifting the phase of read signal. The hybrid RF device 181 delays the phase of the read signal input to the input terminal 181A for 180 degrees and outputs the delayed read signal to the output terminal 181B without changing or shifting the phase of read signal.

Accordingly, the hybrid RF device 181 output the two read signals that have 180 degree phase difference from the output terminals 181B and 181C.

The output terminal 181C of the hybrid RF device 181 is connected to the input terminal 182A of the hybrid RF device 182. The delayed read signal of which the phase is delayed for 180 degree with respect to that of the original read signal output from the reader-writer is input to the input terminal 182A.

The hybrid RF device 182 outputs the read signal input to the input terminal 182A to the output terminal 182B without changing or shifting the phase of read signal. The hybrid RF device 182 delays the phase of the read signal input to the input terminal 182A for 90 degrees and outputs the delayed read signal to the output terminal 182C.

Accordingly, the hybrid RF device 182 output the two read signals that have 90 degree phase difference from the output terminals 182B and 182C.

Since the read signal input to the hybrid RF device 182 is delayed for 180 degrees with respect to the original read signal output from the reader-writer, the read signals output from the output terminals 182B and 182C are delayed for 180 degrees and 270 degrees with respect to the original read signal.

The output terminals 182B and 182C of the hybrid RF device 182 are connected to the feeding point 113C1 and 113D1, respectively.

The output terminal 181B of the hybrid RF device 181 is connected to the input terminal 183A of the hybrid RF device 183. The read signal having the same phase as that of the read signal output from the reader-writer is input to the input terminal 183A.

The hybrid RF device 183 outputs the read signal input to the input terminal 183A to the output terminal 183B without changing or shifting the phase of read signal. The hybrid RF device 183 delays the phase of the read signal input to the input terminal 183A for 90 degrees and outputs the delayed read signal to the output terminal 183C.

Accordingly, the hybrid RF device 183 outputs the two read signals that have 90 degree phase difference from the output terminals 183B and 183C.

Since the read signal input to the hybrid RF device 183 has the same phase as that of the original read signal output from the reader-writer, the read signals output from the output terminals 183B and 183C are delayed for 0 degrees and 90 degrees with respect to the original read signal.

The output terminals 183B and 183C of the hybrid RF device 183 are connected to the feeding point 113A1 and 113B1, respectively.

By utilizing the hybrid RF devices 181, 182 and 183, it is possible to input the read signals that are delayed for 0 degrees, 90 degrees, 180 degrees and 270 degrees with respect to the original read signal output from the reader-writer to the feeding points 113A1 to 113D1, respectively.

The antenna apparatus 100 radiates circular polarized read signals to the positive Z-axis direction by causing antenna elements 110A to 110D to radiate read signals having 90 degree phase differences sequentially in this order.

Next, the detailed configuration of the antenna element 110A will be described with reference to FIGS. 5A and 5B.

Figure 5A:
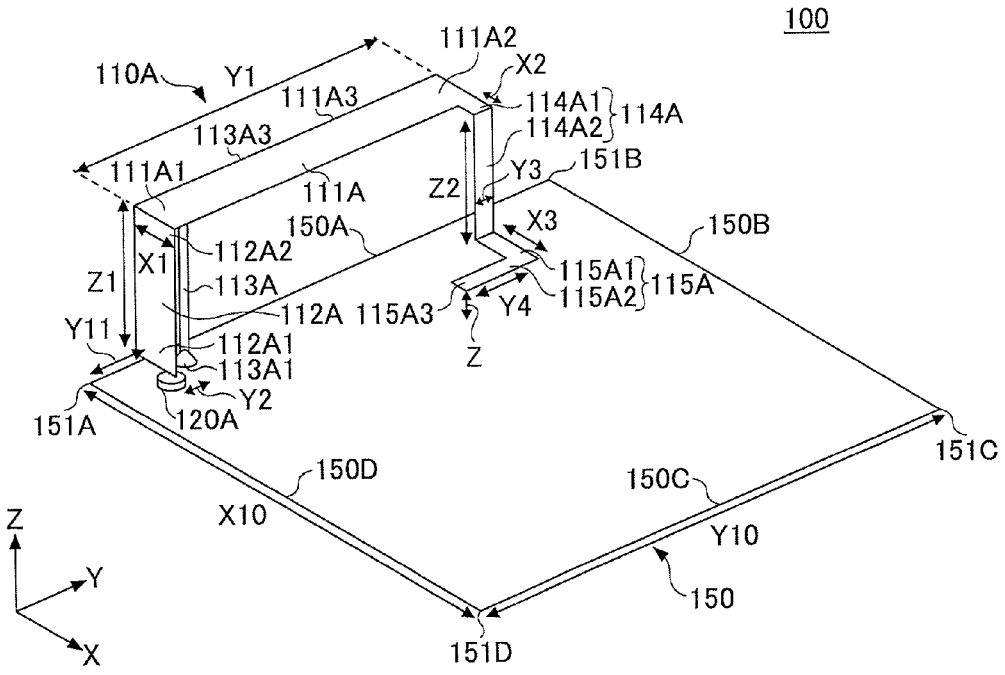
FIG. 5A is a diagram illustrating the antenna element 110A of the antenna apparatus 100 of the embodiment in oblique perspective view.

FIG. 5A is a diagram illustrating the antenna element 110A of the antenna apparatus 100 of the embodiment in oblique perspective view. FIG. 5B is a diagram illustrating the antenna element 110A of the antenna apparatus 100 of the embodiment in side view. FIG. 5B is a side view of the antenna element 110A as viewed from the positive side of the X-axis. In FIGS. 5A and 5B, the capacitor 120A and the ground plane 150 are illustrated in addition to the antenna element 110A.

The antenna element 110A includes the main strip 111A, the short strip 112A, the feeding strip 113A, the open strip 114A and the end strip 115A.

The main strip 111A extends in the Y-axis direction along the side 150A of the ground plane 150. The main strip 111A is parallel to the ground plane 150. In other words, the main strip 111A is parallel to the X-Y plane.

The end portion 111A1 located in the negative side in the Y-axis direction of the main strip 111A is connected to an end portion 112A2 of the short strip 112A, and the end portion 111A2 located in the positive side in the Y-axis direction of the main strip 111A is connected to a first strip 114A1 of the open strip 114A.

An end portion 113A2 of the feeding strip 113A is connected to the surface located in the negative side in the Z-axis direction of the main strip 111A between the end portion 111A1 and the end portion 111A2. The end portion 113A2 may be connected to the main strip 111A by soldering or the like, for example.

Width X1 of the main strip 111A in the X-axis direction is 5 mm, for example, and is equal to that of the short strip 112A in the X-axis direction. Length Y1 of the main strip 111A in the Y-axis direction is 33 mm, for example. Thickness of the main strip 111A is 0.1 mm, for example.

An end portion 112A1 located in the negative side in the Z-axis direction of the short strip 112A is connected to the ground plane 150 via the capacitor 120A. An end portion 112A2 located in the positive side in the Z-axis direction of the short strip 112A is connected to the end portion 111A1 of the main strip 111A.

Since the short strip 112A is parallel to the X-Z plane, the short strip 112A is standing with respect to the ground plane 150.

The capacitor 120A is connected to the endmost portion of the end portion 112A1 which is located in the positive side in the X-axis direction. According to an electromagnetic field simulation, it is determined that impedance characteristics of the antenna element 110A is degraded, if the capacitor 120A is connected to the endmost portion of the end portion 112A1 which is located in the negative side in the X-axis direction. Accordingly, it is preferable to connect the capacitor 120A to a portion of the end portion 112A1 in the X-axis direction which is located closer to the positive side endmost than the negative side endmost. It is most preferable to connect the capacitor 120A to the positive side endmost of the end portion 112A1 in the X-axis direction. The end portion 112A1 is one example of a short end.

The short strip 112A may be formed with the main strip 111A in an integrated fashion, for example. The width X1 of the main strip 111A in the X-axis direction is 5 mm, for example, and is equal to that of the short strip 112A in the X-axis direction. Length Z1 of the short strip 112A in the Z-axis direction is 15 mm, for example. Thickness of the short strip 112A is 0.1 mm, for example.

The short strip 112A is connected to the ground plane 150 in a manner that alternating current can flow between the short strip 112A and the ground plane 150.

The end portion in the negative side in the Z-axis direction of the feeding strip 113A is the feeding point 113A1, and the end portion 113A2 located in the positive side in the Z-axis direction of the feeding strip 113A is connected to the surface of the main strip 111A located in the negative side in the Z-axis direction. The end portion 113A2 may be connected to the main strip 111A by soldering or the like, for example. The feeding strip 113 may be a pillar like member made of metal, for example.

The feeding point 113A1 may be fed by a cable core of a coaxial cable having 50 Ohm characteristic impedance, for example. In a case where the ground plane 150 is formed on the surface of the substrate 160 located in the positive side in the Z-axis direction, feeding point 113A1 may be fed via a strip line formed on the opposite surface of the substrate 160 and a through hole which penetrates through the substrate.

Length Z1 of the feeding strip 113A in the Z-axis direction and length Z1 of the short strip 112A in the Z-axis direction are equal to each other. Both lengths of Z1 are 15 mm, for example. A distance Y2 between the feeding point 113A1 and the end portion 112A1 of the short strip 112A in the Y-axis direction is 3.5 mm, for example.

The open strip 114A includes the first strip 114A1 and a second strip 114A2. The first strip 114A1 extends from the end portion 111A2 of the main strip 111A to the positive X-axis direction. The first strip 114A1 is parallel to the ground plane 150. In other words, the first strip 114A1 is parallel to the X-Y plane.

The second strip 114A2 extends from an end portion located in the positive side in the X-axis direction of the first strip 114A1 to the negative Z-axis direction. An end strip 115A is connected to an end portion located in the negative side in the Z-axis direction of the second strip 114A2.

Width Y3 of the first strip 114A1 and width Y3 of the second strip 114A2 in the Y-axis direction are equal to each other. Both widths Y3 are 2 mm, for example. Length X2 of the first strip 114A1 in the X-axis direction is 2 mm, for example, and length Z2 of the second strip 114A2 in the Z-axis direction is 12 mm, for example.

The second strip 114A2 is bent at a right angle in the negative Z-axis direction with respect to the first strip 114A1. Accordingly, the second strip 114A2 is parallel to the Z-axis.

The open strip 115A includes a first strip 115A1 and a second strip 115A2. The first strip 115A1 and the second strip 115A2 are parallel to the ground plane 150. In other words, the first strip 115A1 and the second strip 115A2 are parallel to the X-Y plane.

The first strip 115A1 extends from an end portion located in the negative side in the X-axis direction of the second strip 114A2 to the positive X-axis direction. The second strip 115A2 extends from an end portion located in the positive side in the X-axis direction of the first strip 115A1 to the negative Y-axis direction. A distal end of the second strip 115A2 is an open end 115A3.

Width of the first strip 115A1 in the Y-axis direction and width of the second strip 115A2 in the X-axis direction are equal to the widths Y3of the first strip 114A1 and the second strip 114A2 of the open strip 114A and are 2 mm.

Length X3 of the first strip 115A1 in the X-axis direction is 6 mm, for example, and length Y4 of the second strip 115A2 in the Y-axis direction is 6 mm, for example.

Positions of the first strip 115A1 and the second strip 115A2 in the Z-axis direction are equal to that of the end portion located in negative side in the Z-axis direction of the second strip 114A2. Therefore, distance Z3 in the Z-axis direction between the first strip 115A1 and the ground plane 150 is 3 mm, and distance Z'in the Z-axis direction between the second strip 115A2 and the ground plane 150 is 3 mm.

The open strip 114A and the end strip 115A are disposed for the sake of miniaturizing the antenna element 110A by increasing capacity of the open end 115A3 of the antenna element 110A. The capacity of the open end 115A3 is increased by placing the open strip 114A and the end strip 115A closer than the main strip 111A. Further, the open strip 114A and the end strip 115A are disposed for the sake of reducing the mutual coupling between the antenna element 110A and other three antenna elements 110B, 110C and 110D.

The capacitor 120A is inserted in series between the end portion 112A1 of the short strip 112A and the ground plane 150. Capacity of the capacitor 120A is 150 pF, for example. The capacitor 120A connects the short strip 112A and the ground plane 150 in a manner that alternating current can flow therebetween.

The capacitor 120A is not always necessary to be inserted between the end portion 112A1 and the ground plane 150. In a case where the capacitor 120A is not inserted therebetween, the end portion 112A1 is connected to the ground plane 150 directly.

The capacitor 120A is inserted between the end portion 112A1 and the ground plane 150 for the sake of controlling a resonance frequency of the antenna element 110A, improving impedance characteristics of the antenna element 110A and/or miniaturizing the antenna element 110A.

In a case where the ground plane 150 is formed onto the top surface of the substrate 160, the capacitor 120A may be disposed onto the bottom surface of the substrate 160 and may be connected between the end portion 112A1 and the ground plane 150 via through holes penetrating the substrate 160.

The ground plane 150 may be a type of a metallic foil having a square shape in plan view, for example. Length X10 in the X-axis direction and length Y10 in the Y-axis direction of the ground plane 150 may be 50 mm, for example. The ground plane 150 is a so called "ground plate" and is kept at ground potential. The ground plane 150 is formed on the substrate 160, for example.

Distance in the Y-axis direction between the side 150D of the ground plane 150 and the short strip 112A is 5 mm, for example. The antenna element 110A is placed at a position that is located between the corner portions 151A and 151B and is offset to the corner portion 151A with respect to the central point between the corner portions 151A and 151B.

The main strip 111A of the antenna element 110A is placed along the side 150A in a manner that an outer side 113A3 corresponds to the side 150A of the ground plane 150 in plan view.

As described above, the antenna element 110A has a configuration which is obtained by adding the open strip 114A and the end strip 115A to the end portion 111A2 which is an open end of an inverted F antenna element constituted by the main strip 111A, the short strip 112A and the feeding strip 113A.

The antenna element 110A is a type of an inverted F antenna element obtained by adding the open strip 114A and the end strip 115A to the end portion 111A2 which is an open end of the main strip 111A.

Herein, dimensions as described above are examples that are set under a condition where the resonance frequency of the antenna apparatus 100 is set to be 919 MHz, for example. In a case where the resonance frequency of the antenna apparatus 100 is set to be a designated frequency other than 919 MHz, the dimensions of the antenna apparatus 100 may be optimized corresponding to the designated resonance frequency.

The antenna element 110A may be formed by soldering the feeding strip 113A to the main strip 111A, after cutting or punching a metallic foil or metal plate into a shape corresponding to the main strip 111A, the short strip 112A, the open strip 114A and the end strip 115A and bending it to a shape as illustrated in FIG. 5A, for example.

The antenna element 110A may be made of a metal such as copper, aluminum or the like, for example. The ground plane 150 may be made of a metal such as copper, aluminum or the like, for example. It is preferable to form the antenna element 110A and the ground plane 150 by using the same metallic material.

Next, frequency characteristics of S1,1 parameters of the antenna element 110A and an antenna element 10 of a comparative example will be described with reference to FIGS. 6A and 6B.

Figure 6A:
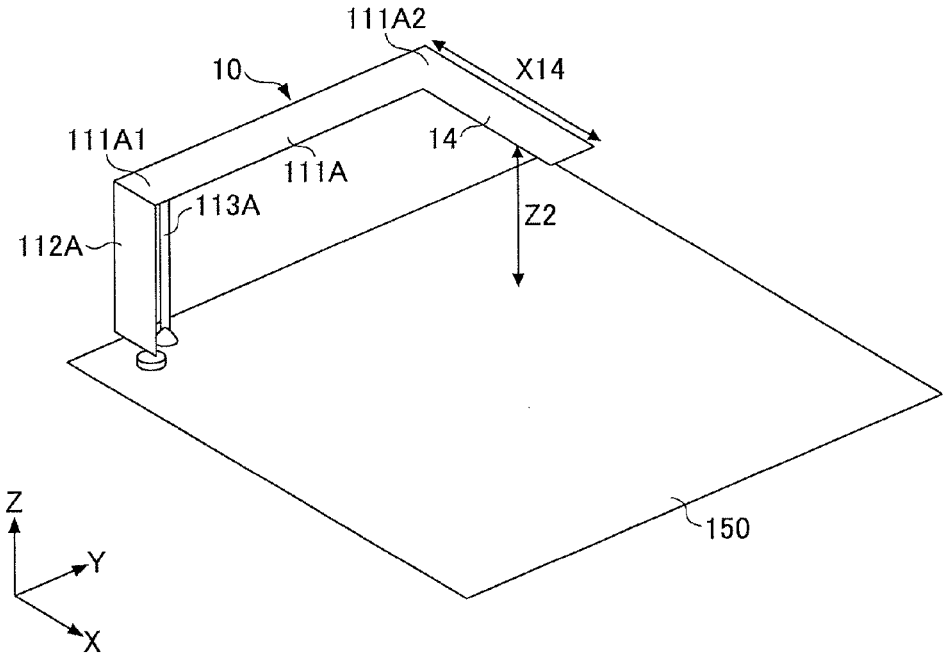
FIG. 6A is a diagram illustrating an antenna element 10 of the comparative example.

FIG. 6A is a diagram illustrating an antenna element 10 of the comparative example. FIG. 6B is a diagram illustrating frequency characteristics of S1,1 parameters of the antenna element 110A of the present embodiment and the antenna element 10 of the comparative example.

The antenna element 10 of the comparative example as illustrated in FIG. 6A has a configuration which includes an open strip 14 connected to the end portion 111A2 of the main strip 111A instead of the open strip 114A and the end strip 115A of the antenna element 110A.

The open strip 14 extends from the end portion 111A2 of the main strip 111A to the positive X-axis direction. Length X–of the open strip 14 from the end portion 111A2 of the main strip 111A to a distal end thereof is 31 mm, for example, and height Z2 from the ground plane 150 is 15 mm, for example.

As described above, the open strip 14 is as high as the main strip 111A with respect to the ground plane 150.

Figure 6B:
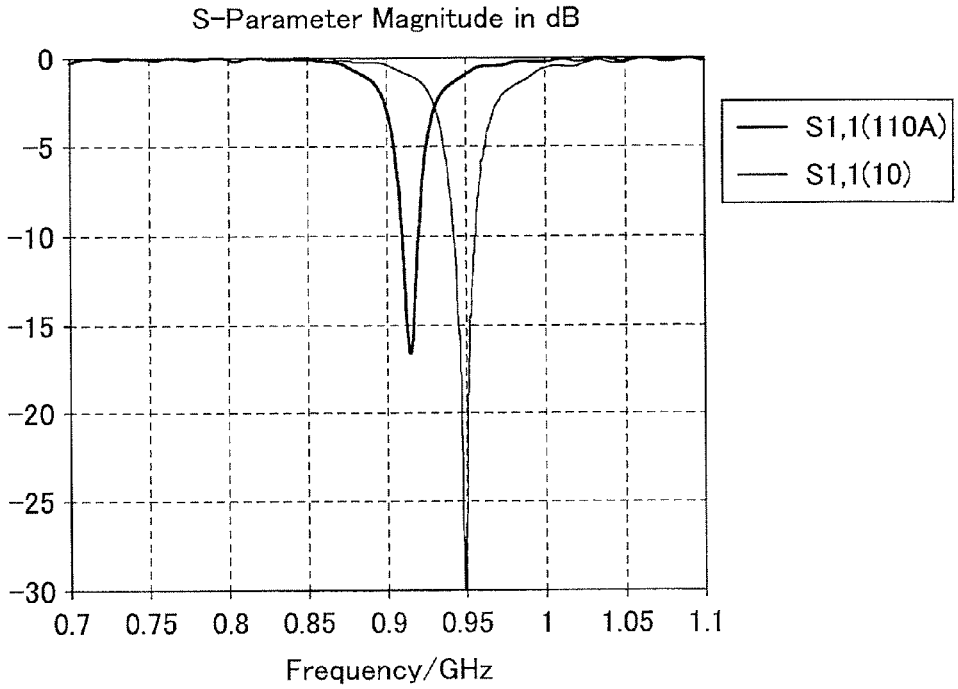
FIG. 6B is a diagram illustrating frequency characteristics of S1, 1 parameters of the antenna element 110A of the present embodiment and the antenna element 10 of the comparative example.

In FIG. 6B, the frequency characteristic of the S1,1 parameter of the antenna element 110A is represented by a solid line, and the frequency characteristic of the S1,1 parameter of the antenna element 10 is represented by a dashed line.

As illustrated in FIG. 6B, the resonance frequency (center frequency) of the antenna element 110A is about 920 MHz, and the minimum value of the S1,1 parameter is about −17 dB.

The resonance frequency (center frequency) of the antenna element 10 is about 950 MHz, and the minimum value of the S1,1 parameter is about −30 dB.

According to the present embodiment, it becomes possible to lower the resonance frequency of the antenna element 110A compared with that of the antenna element 10 of the comparative example. This means that it is possible to make the antenna element 110A smaller than the antenna element 10 of the comparative example.

In fact, as for the antenna element 110A, length of the open strip 114A and the end strip 115A is 26 mm (=X2+Z2+X3+X4), and becomes 28 mm if the width Y3 of the open strip 114A is added thereto.

Length of the open strip 14 of the antenna element 10 is 31 mm (=X14), and becomes 36 mm if the width X1 of the main strip 111A is added thereto.

As described above, the length of the open end side of the antenna element 110A is shorter than length of the open strip 14 of the antenna element 10 of comparative example.

Although value of the S1,1 parameter of the antenna element 110A is higher than that of the antenna element 10, the minimum value (about −17 dB) of the antenna element 110A is a good value and low enough.

According to the present embodiment, it becomes possible to downsize the antenna element 110A by lowering the resonance frequency which is achieved by increasing the capacity of the open end 115A3 side. The capacity is increased by connecting the open strip 114A and the end strip 115A to the end portion 111A2 of the main strip 111A.

Next, electric field distributions of the antenna apparatus 100 according to the present embodiment will be described with reference to FIG. 7.

Figure 7:
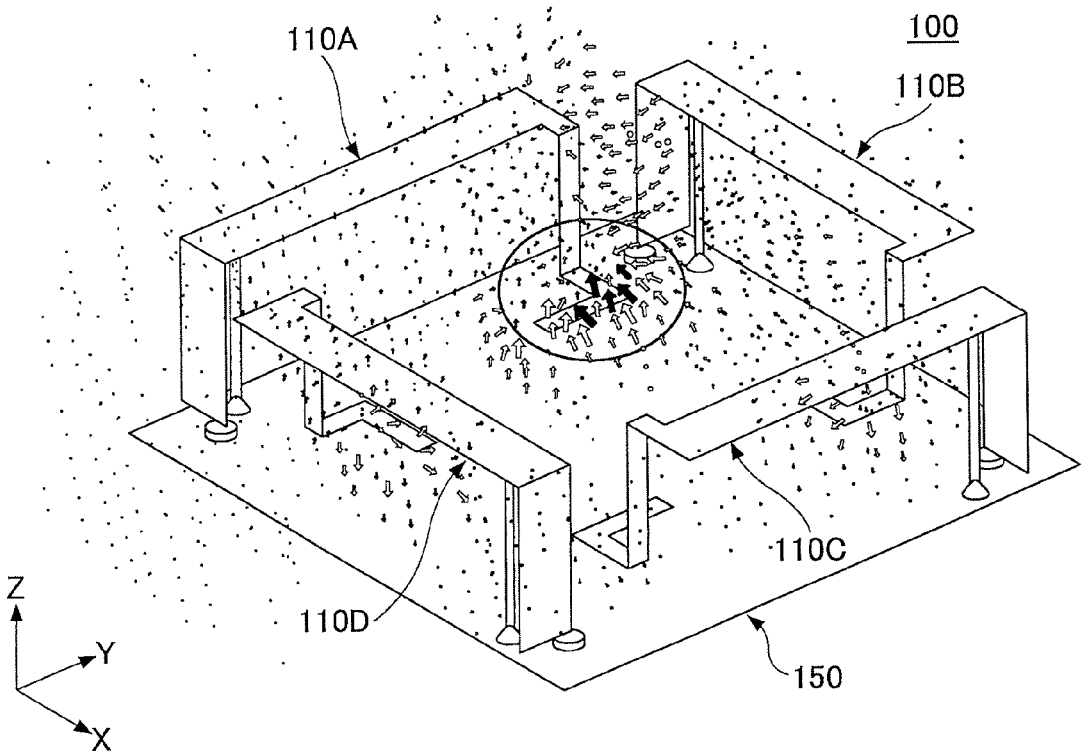
FIG. 7 is a diagram illustrating electric field distributions of the antenna apparatus of the present embodiment.

FIG. 7 is a diagram illustrating electric field distributions of the antenna apparatus 100 of the present embodiment. The electric field distributions as illustrated in FIG. 7 are obtained by a simulation performed by an electromagnetic field simulator.

The antenna apparatus 100 as illustrated in FIG. 7 is as same as that illustrated in FIG. 1, but the reference signs other than the antenna elements 110A to 110D and the ground plane 150 are omitted.

The electric field distributions of the antenna apparatus 100 as illustrated in FIG. 7 are obtained in a condition where only the antenna element 110A is being fed.

In FIG. 7, the electric field distributions are represented by grayscale and directions of electric fields are represented by arrows. The bolder the arrows become, the stronger the electric fields become. The finer the arrows become, the weaker the electric fields become. In areas where the electric fields are so weak, the electric fields are represented not by arrows but by points.

As illustrated in FIG. 7, in a condition where the antenna element 110A is being fed, the electric fields are concentrated around the open strip 114A and the end strip 115A. Particularly, the electric fields around the end strip 115A become the strongest (see in a circle as illustrated in FIG. 7).

The reason why the electric fields around the end strip 115A become the strongest is because the open strip 114A and the end strip 115A are placed closer to the ground plane 150 than the main strip 111A, and thus the capacity around the open end 115A3 of the antenna element 110A is greater than that of the main strip 111A.

Next, S parameters obtained by the antenna apparatus 100 and a Smith chart will be described with reference to FIGS. 8A and 8B.

Figure 8A:
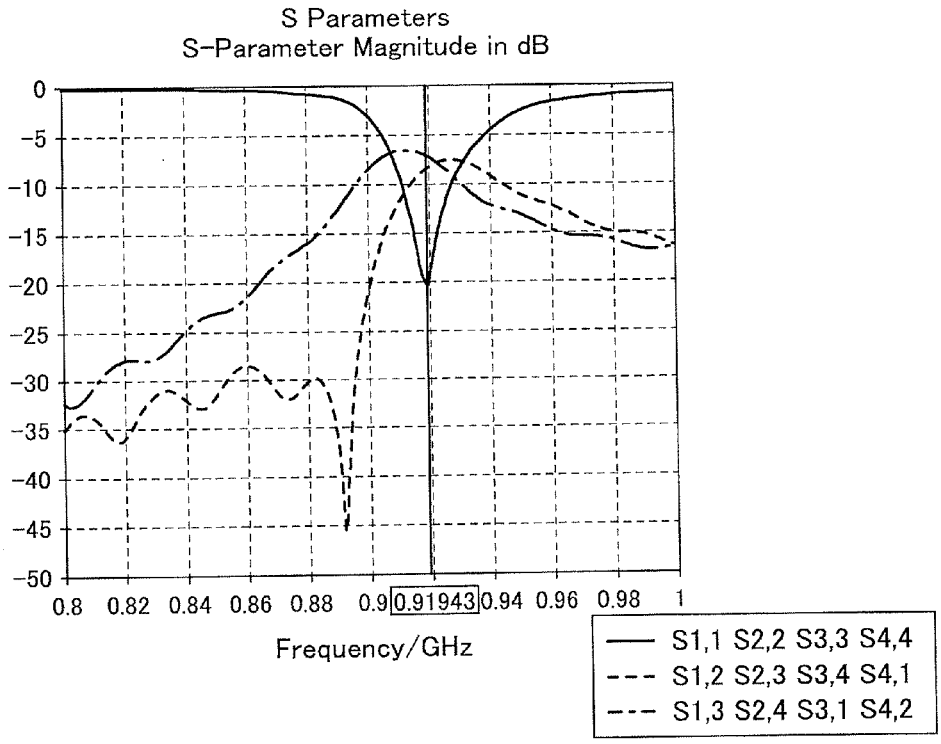
FIG. 8A is a diagram illustrating S parameters of the antenna apparatus 100 of the embodiment.

FIG. 8A is a diagram illustrating S parameters of the antenna apparatus 100 of the embodiment. FIG. 8B is a diagram illustrating a Smith chart of the antenna apparatus 100 of the embodiment.

FIG. 8A illustrates S parameters of the antenna apparatus 100. S parameters of the antenna apparatus 100 are obtained by treating the antenna elements 110A to 110D as number 1 port to number 4 port, respectively.

The S1,1, S2,2, S3,3, S4,4 parameters are represented by solid lines, the S1,2, S2,3, S3,4, S4,1 parameters are represented by dashed lines and the S1,3, S2,4, S3,1, S4,2 parameters are represented by alternate long and short dash lines, respectively.

The S1,1, S2,2, S3,3, S4,4 parameters represented by solid lines indicate ratios of reflected power to input power. The S1,2, S2,3, S3,4, S4,1 parameters represented by dashed lines and the S1,3, S2,4, S3,1, S4,2 parameters represented by alternate long and short dash lines indicate power gain.

As illustrated in FIG. 8A, values of the S1,1, S2,2, S3,3, S4,4 parameters are about −0 dB at the resonance frequency of 919 MHz. These values indicate that impedance matching of the antenna elements 110A to 110D is obtained.

The S1,2, S2,3, S3,4, S4,1 parameters and the S1,3, S2,4, S3,1, S4,2 parameters are well balanced at the resonance frequency of 919 MHz, and the values of the parameters are about −10 dB. Accordingly, high power gain is obtained.

Figure 8B:
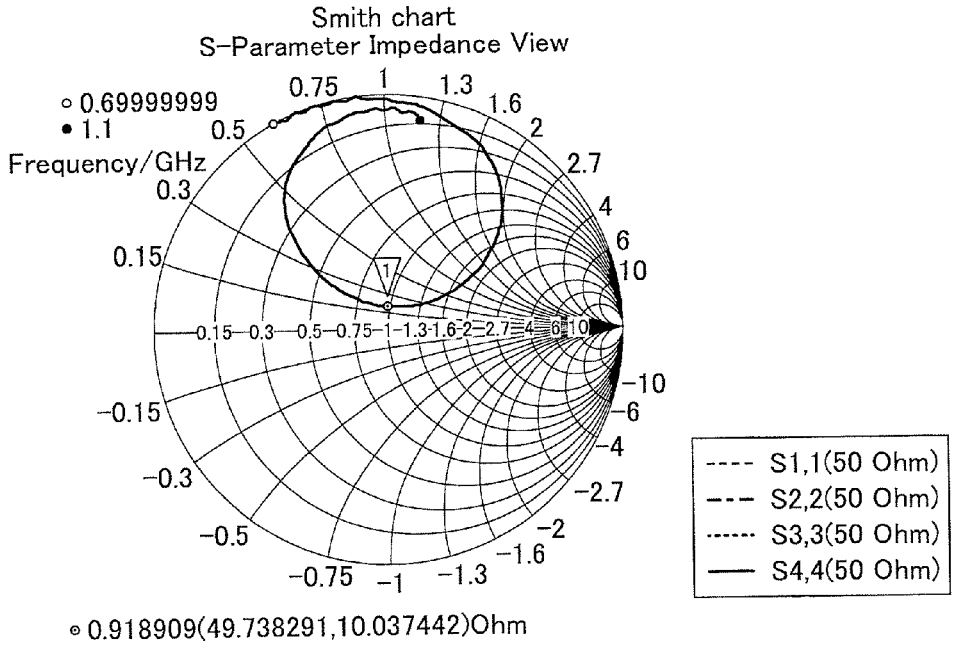
FIG. 8B is a diagram illustrating a Smith chart of the antenna apparatus 100 of the embodiment.

According to the Smith chart as illustrated in FIG. 8B, it turns out that the impedance of the antenna apparatus 100 is controlled to be 50 Ohms at the triangle point 1. All of the S1,1, S2,2, S3,3, S4,4 parameters are controlled to be 50 Ohms. According to the embodiment, the capacitors 120A to 120D are used in order to improve the characteristics of the Smith chart.

Next, directivity of the antenna apparatus 100 according to the present embodiment will be described with reference to FIGS. 9A and 9B.

Figure 9A:
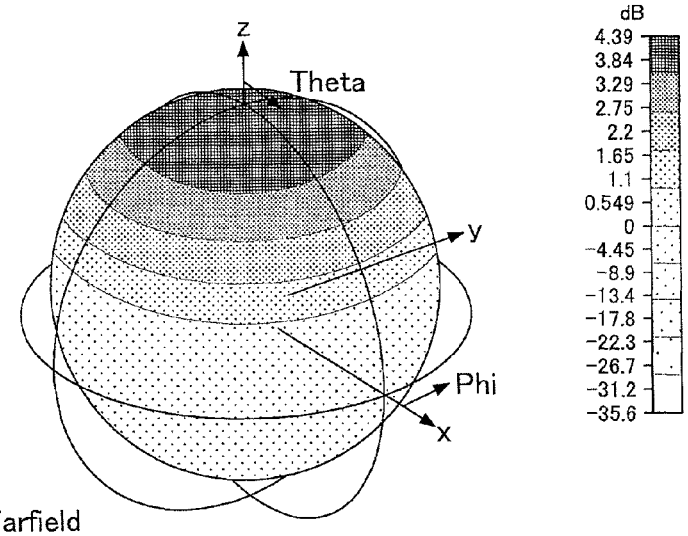
FIG. 9A is a diagram illustrating the directivity (3D radiation patterns) of the antenna apparatus 100 of the embodiment.

FIG. 9A is a diagram illustrating the directivity (3D radiation patterns) of the antenna apparatus 100 of the embodiment. FIG. 9B is a diagram illustrating the directivity (AR patterns) of the antenna apparatus 100 of the embodiment.

Figure 9B:
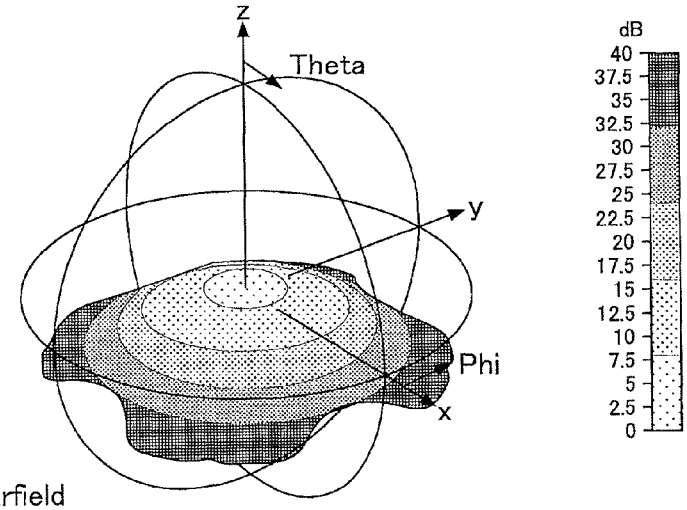
FIG. 9B is a diagram illustrating the directivity (AR patterns) of the antenna apparatus 100 of the embodiment.

FIG. 9A illustrates the 3D radiation patterns of the antenna apparatus 100, and FIG. 9B illustrates the AR patterns of the antenna apparatus 100.

The 3D radiation patterns as illustrated in FIG. 9A and AR patterns as illustrated in FIG. 9B are obtained in a condition where the original point of the XYZ coordinate system is placed in the central point of the corner portions 151A to 151D on the top surface of the ground plane 150.

The even and well balanced 3D radiation patterns as illustrated in FIG. 9A are obtained by radiating the read signals having 90 degree phase differences and the same amplitudes from the four antenna elements 110A to 110D. The resonance frequency of the signals is 919 MHz.

The maximum gain is about 4.4 dB. It turns out that the obtained gain is very high and is greater than 3 dB at 919 MHz.

The total efficiency of the antenna elements 110A to 110D is −0.69 dB, and total radiation efficiency is −0.07 dB.

As illustrated in FIG. 9B, Axial Ratio (AR) patterns indicate lowered gains around the center axis (Z-axis). Accordingly, it is possible to radiate well balanced circular polarized read signals that have small gain at the center of the circular polarization by radiating read signals having 90 degree phase differences and the same amplitudes from the four antenna elements 110A to 110D.

Next, mutual coupling of the antenna elements 110A to 110D of the antenna apparatus 100 of the present embodiment and mutual coupling of antenna elements 10A to 10D of an antenna apparatus 11 of the comparative example will be described with reference to FIGS. 10A, 10B and 10C.

Figure 10A:
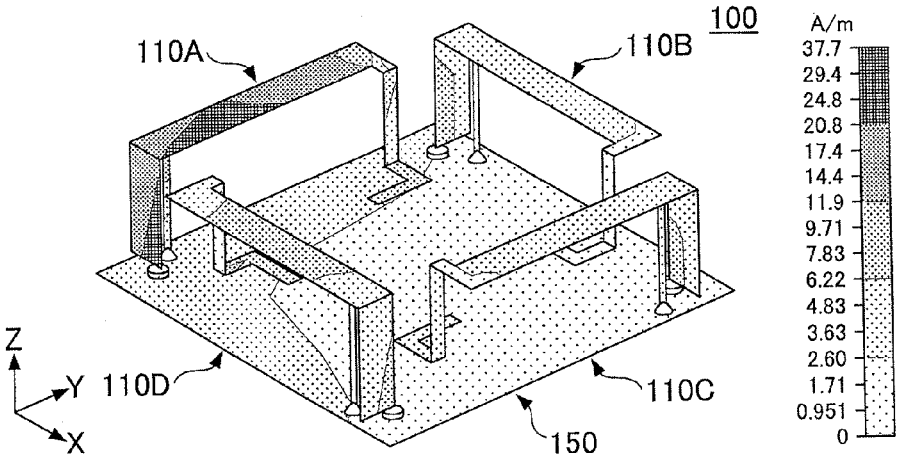
FIG. 10A is a diagram illustrating current distributions of the antenna apparatus of the embodiment and an antenna apparatus of the comparative example.
Figure 10B:
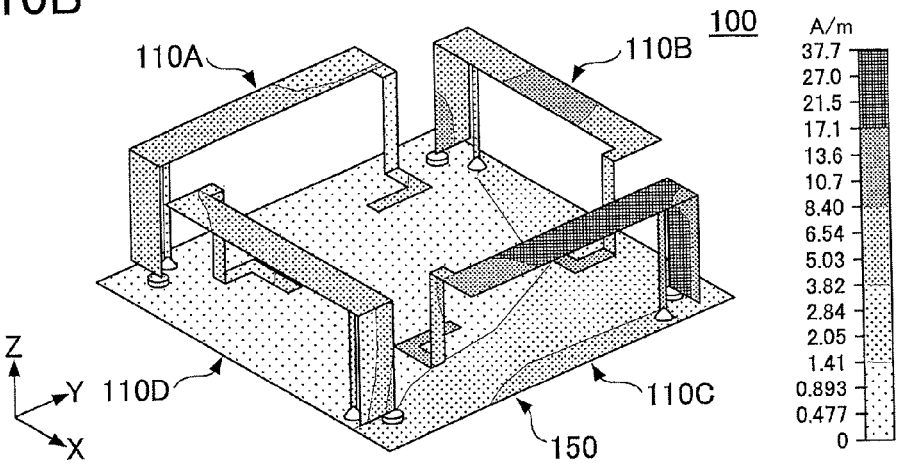
FIG. 10B is a diagram illustrating current distributions of the antenna apparatus of the embodiment and an antenna apparatus of the comparative example.
Figure 10C:
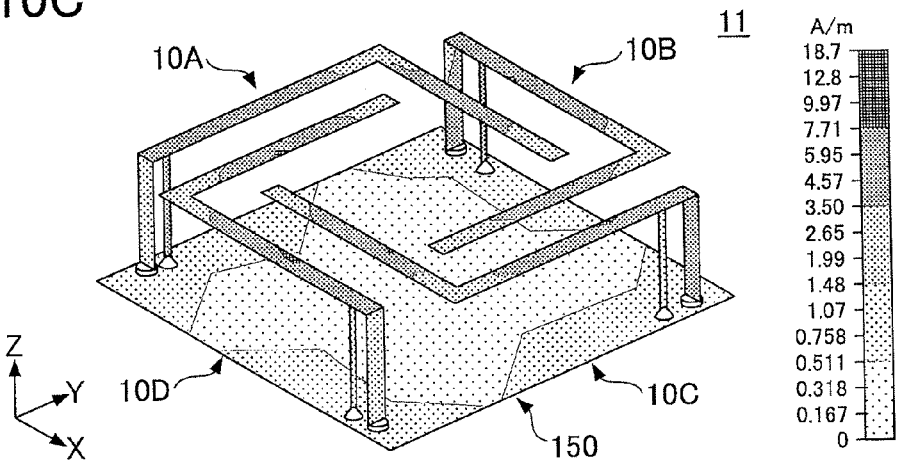
FIG. 10C is a diagram illustrating current distributions of the antenna apparatus of the embodiment and an antenna apparatus of the comparative example.

FIGS. 10A, 10B and 10C are diagrams illustrating current distributions of the antenna apparatus 100 of the embodiment and antenna apparatus 11 of the comparative example.

FIG. 10A illustrates current distributions of the antenna apparatus 100 in a case where only the antenna element 110A is being fed.

As illustrated in FIG. 10A, very low currents are flowing through the antenna elements 110B, 110C and 110D that are not being fed in a case where only the antenna element 110A is being fed. In this case, current is flowing only through the antenna element 110A.

FIG. 10B illustrates current distributions of the antenna apparatus 100 in a case where only the antenna element 110C is being fed.

As illustrated in FIG. 10B, very low currents are flowing through the antenna elements 110A, 110B and 110D that are not being fed in a case where only the antenna element 110C is being fed. In this case, current is flowing only through the antenna element 110C.

According to FIGS. 10 (A) and (B), it turns out that mutual coupling of the antenna elements 110A to 110D of the antenna apparatus 100 is reduced.

FIG. 10C illustrates current distributions of the antenna apparatus 11 of the comparative example which includes antenna elements 10A, 10B, 10C and 10D instead of the antenna elements 110A to 110D. The current distributions as illustrated in FIG. 10C are obtained in a case where only the antenna element 10A is being fed.

Each of the antenna elements 10A, 10B, 10C and 10D is the same as the antenna element 10 as illustrated in FIG. 6A. Accordingly, the antenna apparatus 11 of the comparative example has a configuration which includes the ground plane 150 and the antenna elements 10A, 10B, 10C and 10D disposed on the ground plane 150.

According to FIG. 10C, it turns out that current is flowing through all of the antenna elements 10A, 10B, 10C and 10D in a case where only the antenna element 10A is being fed.

The reason why the current is flowing through all of the antenna elements 10A, 10B, 10C and 10D in a case where only the antenna element 10A is being fed is that mutual coupling of the antenna elements 10A, 10B, 10C and 10D is high. Each of the antenna elements 10A, 10B, 10C and 10D includes the open strip 14 (see FIG. 6A). As illustrated in FIG. 10C, the main strip 111A of one antenna element among the antenna elements 10A, 10B, 10C and 10D is arranged parallel to and adjacent to the open strip 14 of the neighborhood antenna element among the antenna elements 10A, 10B, 10C and 10D to each other. The main strips 111A are main current paths of the antenna element 10A, 10B, 10C and 10D, respectively.

Accordingly, it is considered that mutual coupling of the two adjacent antenna elements among the antenna elements 10A, 10B, 10C and 10D becomes strong, and the current is flowing not only through the antenna element 10A but also through the antenna elements 10B, 10C and 10D in a case where only the antenna element 10A is being fed.

On the contrary, the antenna apparatus 100 includes the open strip 114A and the end strip 115A that are disposed on a side of the end portion 111A2 which is the open end of the main strip 111A of the antenna element 110A. The open strip 114A extends from the end portion 111A2 of the main strip 111A to the negative X-axis direction, and the end strip 115A is connected to the open strip 114A.

Accordingly, the open strip 114A and the end strip 115A of the antenna element 110A are disposed in a position away from the main strip 111B of the adjacent antenna element 110B compared with the open strip 14 of the antenna element 10 (see FIG. 6A).

The second strip 115A2 of the end strip 115A extends in a direction away from the antenna element 110B which is located the closest (nearest) to the end strip 115A among the antenna elements 110B, 110C and 110D. The end strip 115A extends in the negative Y-axis direction.

The same applies to the configurations of the antenna elements 110B, 110C and 110D.

The antenna apparatus 100 reduces the mutual coupling of the antenna elements 110A to 110D by utilizing the configuration as described above.

Figure 11:
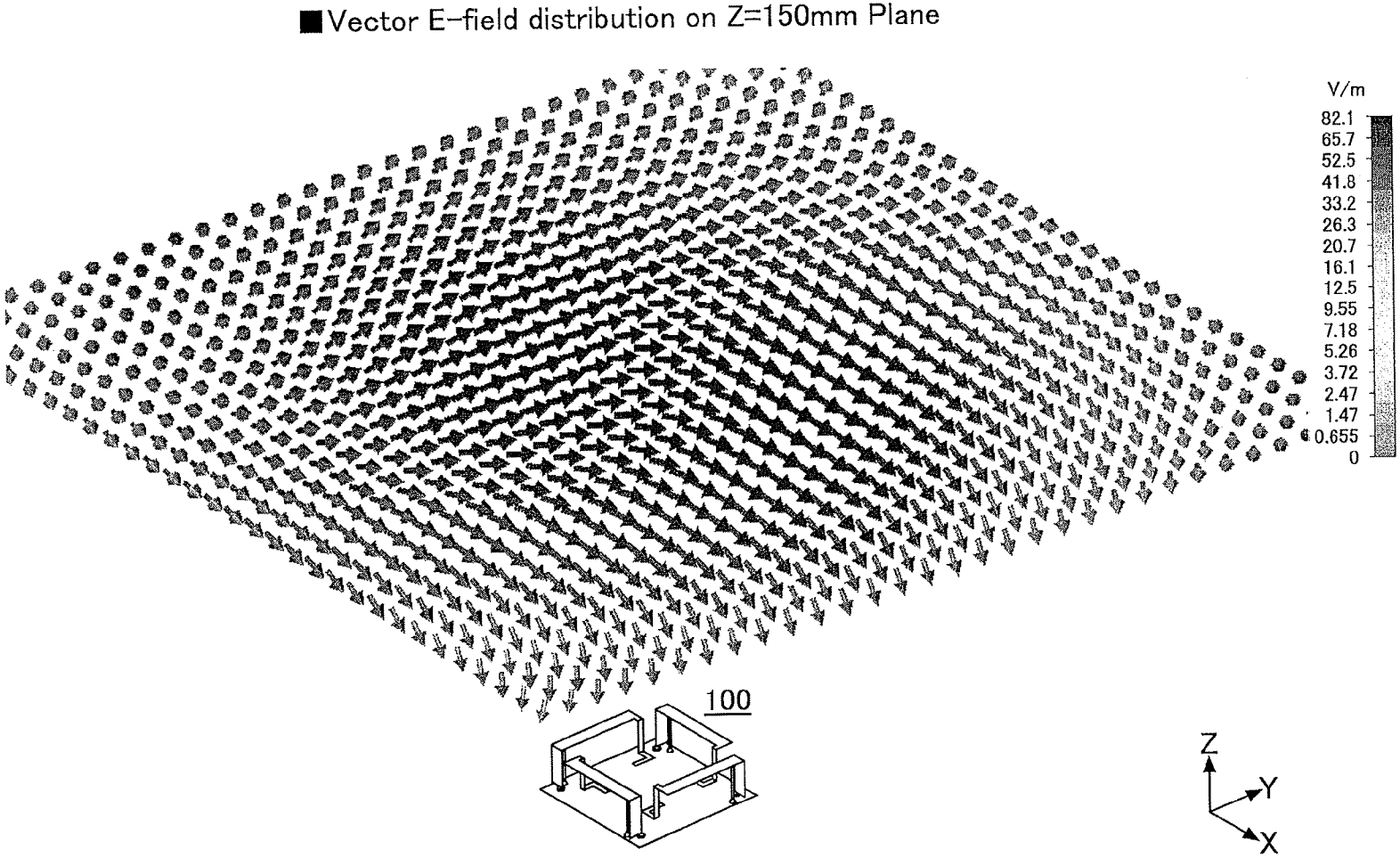
FIG. 11 is a diagram illustrating electric field distributions obtained above the antenna apparatus of the present embodiment.

FIG. 11 is a diagram illustrating electric field distributions obtained above the antenna apparatus 100 of the present embodiment. The electric field distributions are illustrated by arrows. FIG. 11 illustrates the electric field distributions obtained on a plane parallel to the X-Y plane which is located at a 150 mm height from the surface of the ground plane 150. The electric field distributions as illustrated in FIG. 11 is obtained at a certain instant in time while the antenna elements 110A to 110D are radiating read signals having 90 degree phase differences sequentially in this order. The phases of the read signals radiated from the antenna elements 110B, 110C and 110D are delayed for 90 degree, 180 degree and 270 degree with respect to the phase of the read signal radiated from the antenna element 110A, respectively. Herein, one cycle of the read signal corresponds to 360 degree.

The central point of the electric field distributions as illustrated in FIG. 11 corresponds to the central point of the ground plane 150.

It turns out that it is possible to form electric field distributions that are bent from the positive Y-axis direction to the positive X-axis direction as illustrated in FIG. 11. Since the electric field distributions as illustrated in FIG. 11 is obtained at a certain instant in time, the electric field distributions that are bent from the positive Y-axis direction to the positive X-axis direction are illustrated. The electric field distributions that are obtained for a longer period of time form a circle.

Accordingly, the antenna apparatus 100 can radiate circular polarized read signals by causing the antenna elements 110A to 110D to radiate read signals having 90 degree phase differences sequentially in this order.

According to the antenna apparatus 100 of the present embodiment, it is possible to reduce the size of the antenna element 110A by including the open strip 114A and the end strip 115A that are located at the side of the end portion 111A2 and are located closer to the ground plane 150 than the main strip 111A. The end portion 111A2 constitutes the open end of the main strip 111A of the antenna element 110A.

The reason why the antenna apparatus 100 can achieve downsizing of the antenna element 110A is that the capacitance of the antenna element 110A obtained between the antenna element 110A and the ground plane 150 is increased by including the open strip 114A and the end strip 115A. The same applies to the antenna elements 110B, 110C and 110D.

Accordingly, it is possible to provide the antenna apparatus 100 which is very small and useful and is convenient for the user who wants to read IDs of the RFID tags attached to goods. The user can hold the antenna apparatus 100 which is connected to the reader-writer in one hand and cause the antenna apparatus 100 to radiate the read signals toward the goods. The antenna apparatus 100 is a type of the PIFA type antenna. An antenna apparatus with reduced size is provided.

Since the antenna element 110A includes the open strip 114A and the end strip 115A, it is possible to reduce mutual coupling between the antenna element 110A and another antenna elements 110B, 110C and 110D. Particularly, it is possible for the antenna element 110A to reduce mutual coupling between the antenna element 110A and the antenna element 110B which is placed adjacent to the open end 115A3. This is achieved because the antenna element 110A includes the open strip 114A and the end strip 115A.

This is achieved because the open strip 114A extends from the main strip 111A horizontally and is bent vertically toward the ground plane 150, and because the end strip 115A extends in a direction away from another antenna elements 110B, 110C and 110D, particularly from the antenna element 110B. The same applies to the antenna elements 110B, 110C and 110D.

The antenna apparatus 100 includes the four antenna elements 110A to 110D that have the four main strips 111A to 111D arranged to draw a square with corners at 90 degrees in plan view. The antenna apparatus 100 radiates the read signals having 90 degree phase differences sequentially from the four antenna elements 110A to 110D in this order.

Since the mutual couplings of the antenna elements 110A to 110D are reduced as described above, the read signals having 90 degree phase differences are radiated from the antenna elements 110A to 110D in a good condition that influences of the mutual couplings are reduced.

Accordingly, the antenna apparatus 100 can radiate the read signals that form a high gain electrical field and have an excellent axial ratio.

If the user holds the antenna apparatus 100 in one hand and causes the antenna apparatus 100 to radiate the read signals toward the goods to which the RFID tags are attached, it is possible to read the IDs of the RFID tags even in a case where the goods are contained in boxes or displayed on shelves.

It is much easier to read the IDs of the RFID tags by using the antenna apparatus 100 of the present embodiment than to read IDs by holding the goods toward a conventional antenna which is installed in a fixed object such as agate or in a reader-writer.

Since the antenna apparatus 100 is used for a purpose as described above, for example, it is effective to reduce the size of the antenna apparatus 100 so that the user can hold the antenna apparatus 100 in one hand easily.

Although the antenna element 110A of the antenna apparatus 100 includes the second strip 115A2 as described above, the antenna element 110A may not include the second strip 115A2 as long as the antenna element 110A can obtain an adequate capacity and can be downsized.

In the embodiment as described above, the inverted F antenna element 110A in which the short strip 112A is connected to the end portion 111A1 of the main strip 111A and the feeding strip 113A is connected to the main strip 111A between the end portion 111A1 and the end portion 111A2 The same applies to the antenna elements 110B, 110C and 110D.

However, positions of the short strip 112A and the feeding strip 113A may be interchanged.

Figure 12:
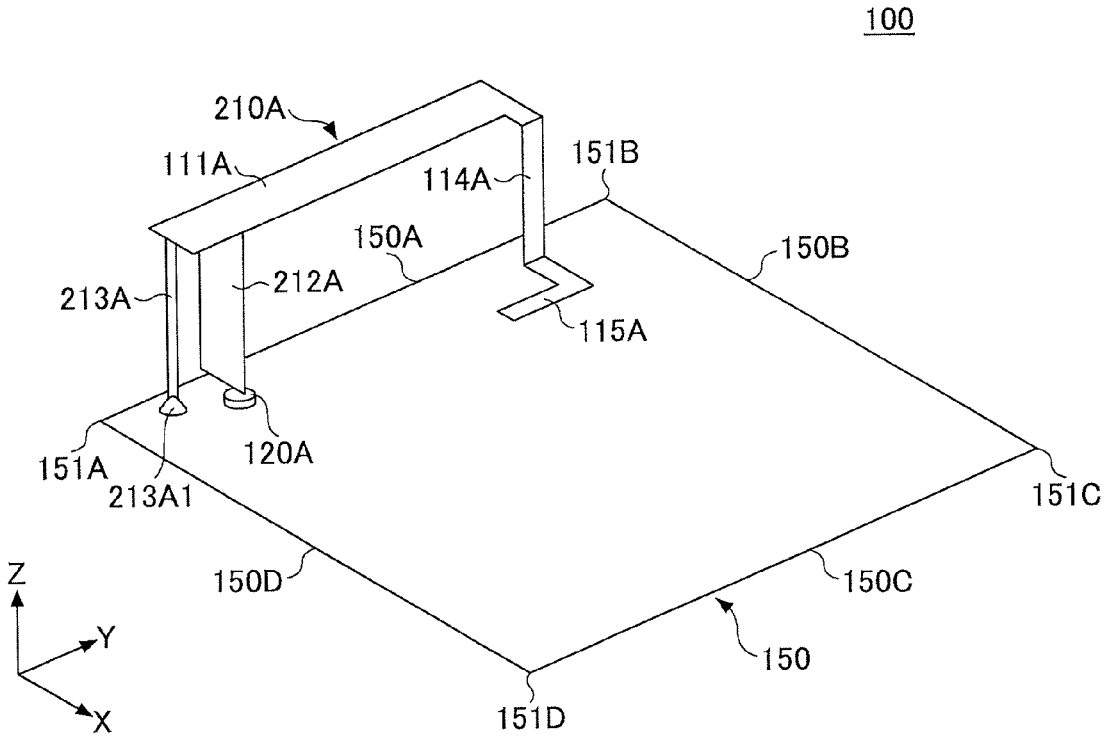
FIG. 12 is a diagram illustrating an antenna element of a modified example of the present embodiment.

FIG. 12 is a diagram illustrating an antenna element 210A of a modified example of the present embodiment. The antenna element 210A includes the main strip 111A, a short strip 212A, a feeding strip 213A, the open strip 114A and the end strip 115A.

Figure 5B:
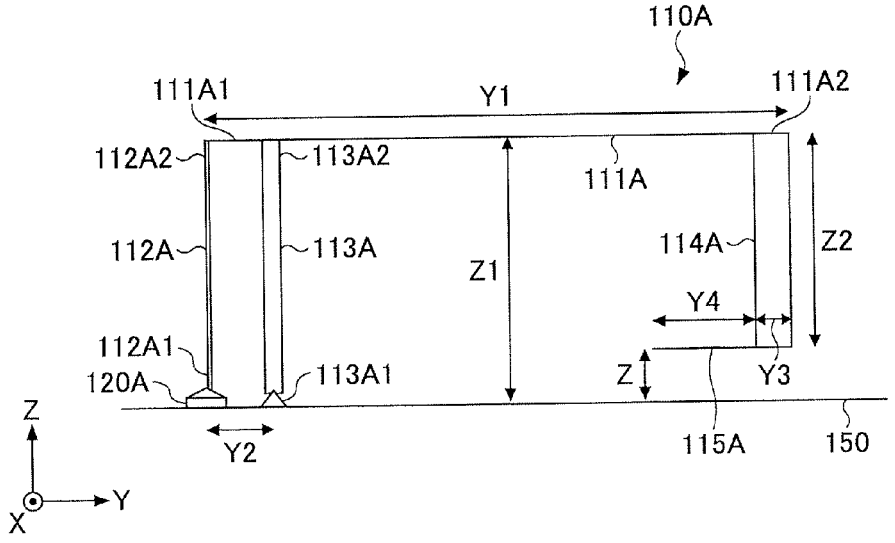
FIG. 5B is a diagram illustrating the antenna element 110A of the antenna apparatus 100 of the embodiment in side view.

The antenna element 210A has a configuration in that positions of the short strip 212A and the feeding strip 213A are interchanged compared with the positions of the short strip 112A and the feeding strip 213A of the antenna element 110A as illustrated in FIGS. 5A and 5B.

Instead of each of the antenna elements 110A to 110D, the antenna element 210A may be used.

The bottom end of the short strip 212A is connected to the ground plane 150 via the capacitor 120A, and a feeding point 213A1 is provided at the bottom end of the feeding strip 213A.

The descriptions of the antenna apparatus of exemplary embodiments have been provided heretofore. The present invention is not limited to these embodiments, but various variations and modifications may be made without departing from the scope of the present invention.

So far, the preferred embodiments and modification of the antenna apparatuses are described. However, the invention is not limited to those specifically described embodiments and the modification thereof, and various modifications and alteration may be made within the scope of the inventions described in the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention.

Although the embodiments of the present invention have been described in detail, it should be understood that the various changes, substitutions, and alterations could be made hereto without departing from the spirit and scope of the invention.

What is claimed is:

1. An antenna apparatus comprising:

a ground plane having a rectangular shape in plan view; and four inverted F antenna elements configured to be placed on the ground plane and to be arranged in a symmetrical manner with respect to the central point of the ground plane in plan view, the four inverted F antenna elements including short ends connected to the ground plane and open ends disposed on the opposite side of the short ends, respectively, wherein each of the four inverted F antenna elements includes:

a main strip configured to be placed parallel to the ground plane at a first height, a short strip configured to extend from one end of the main strip to the ground plane, the short strip having an first end portion that is connected to the ground plane and that constitutes the short end, a feeding strip configured to extend from a middle point of the main strip toward the ground plane, the feeding strip having an second end portion that constitutes a feeding point, an open strip configured to have a third end portion and to extend toward the ground plane from the other end of the main strip to the third end portion placed at a second height lower than the first height, and an end strip configured to have a fourth end portion and to extend from the third end portion of the open strip to the fourth end portion, the fourth end portion constituting the open end, the end strip being placed parallel to the ground plane at the second height, wherein the end strip includes:

a first strip configured to have a fifth end portion and to extend from the third end portion of the open strip to the fifth end portion; and a second strip configured to extend from the fifth end portion of the first strip to the fourth end portion in a direction towards the short strip along the main strip, the fourth end portion constituting the open end.

2. The antenna apparatus as claimed in claim 1, further comprising:

four capacitors configured to be connected in series between the short ends and the ground plane, respectively.

3. The antenna apparatus as claimed in claim 1, wherein the main strips of the four inverted F antenna elements are placed along four sides of the ground plane, respectively, and wherein the open strips of the four inverted F antenna elements extend from inner sides of the main strips in plan view, respectively.

4. The antenna apparatus as claimed in claim 1, wherein the four inverted F antenna elements are disposed in a manner that the short ends are placed close to four corner portions of the ground plane, respectively.

5. The antenna apparatus as claimed in claim 1, further comprising:

a circuit configured to be connected to the four feeding points of the four inverted F antenna elements and to input four read signals to the four feeding points, respectively, wherein the circuit inputs the four read signals having 90 degree phase differences sequentially in this order to the four feeding points of the four inverted F antenna elements that are arranged in clockwise or anticlockwise direction in plan view.

6. The antenna apparatus as claimed in claim 1, further comprising:

a substrate on which the ground plate is formed.

7. The antenna apparatus as claimed in claim 6, further comprising:

a supporting member configured to support the four inverted F antenna elements with respect to the ground plane or the substrate.

8. The antenna apparatus as claimed in claim 6, further comprising:

a cover configured to be placed on the ground plane or the substrate and to cover the four inverted F antenna elements.

9. An antenna apparatus comprising:

a ground plane having a rectangular shape in plan view; and four inverted F antenna elements configured to be placed on the ground plane and to be arranged in a symmetrical manner with respect to the central point of the ground plane in plan view, the four inverted F antenna elements including feeding points disposed on one ends and open ends disposed on the opposite side of the feeding points, respectively, wherein each of the four inverted F antenna elements includes, a main strip configured to be placed parallel to the ground plane at a first height, a feeding strip configured to extend from one end of the main strip toward the feeding point, the feeding strip having a first end portion that constitutes a feeding point, a short strip configured to extend from a middle point of the main strip to the ground plane, the short strip having an second end portion that is connected to the ground plane and that constitutes the short end, an open strip configured to have a third end portion and to extend toward the ground plane from the other end of the main strip to the third end portion placed at a second height lower than the first height, and an end strip configured to have a fourth end portion and extend from the third end portion of the open strip to the fourth end portion, the fourth end portion constituting the open end, the end strip being placed parallel to the ground plane at the second height, wherein the end strip includes:

a first strip configured to have a fifth end portion and to extend from the third end portion of the open strip to the fifth end portion; and a second strip configured to extend from a the fifth end portion of the first strip to the fourth end portion in a direction towards the short strip along the main strip, the fourth end portion constituting the open end.

* * * * *